United States Patent [19]

Liegel et al.

[11] Patent Number: 5,029,814

[45] Date of Patent: Jul. 9, 1991

[54] SCISSOR JACK STAND

[75] Inventors: Reinald D. Liegel, Waukesha; Garry J. Sabel, Milwaukee, both of Wis.

[73] Assignee: Hein-Werner Corporation, Waukesha, Wis.

[21] Appl. No.: 12,270

[22] Filed: Feb. 9, 1987

[51] Int. Cl.[5] ..... B66F 3/22

[52] U.S. Cl. ..... 254/122; 269/133; 254/133 R

[58] Field of Search ..... 254/105, 112, 113, 119, 254/131, 133 R, DIG. 4; 269/905, 133

[56] References Cited

U.S. PATENT DOCUMENTS

| | | | |
|---|---|---|---|
| 1,709,746 | 4/1929 | Schwerin | 254/122 |
| 1,982,642 | 12/1934 | Curok | 254/122 |
| 2,516,483 | 7/1950 | Parker | 254/133 R |
| 2,763,302 | 9/1956 | English | 269/133 |
| 3,266,772 | 8/1966 | Francis | 254/122 |
| 4,055,260 | 10/1977 | Tamas | 254/105 |
| 4,556,163 | 12/1985 | Lundman | 228/173.6 |

FOREIGN PATENT DOCUMENTS

| | | | |
|---|---|---|---|
| 1194047 | 9/1985 | Canada | 269/133 |

*Primary Examiner*—J. J. Hartman

*Attorney, Agent, or Firm*—Michael, Best & Friedrich

[57] ABSTRACT

An adjustable support device comprising a first elongated member having an upper end, a second elongated member having an upper end, a mechanism for connecting the first member to the second member such that the upper ends of the first and second members are vertically, adjustably movable in response to movement of the first elongated member with respect to the second elongated member, and a ratch connected between a first point located on the first member and a second point located on the second member for releasably securing the first and second points in spaced relationship and for selectively varying the spacing between the first and second points.

39 Claims, 2 Drawing Sheets

SCISSOR JACK STAND

BACKGROUND OF THE INVENTION

The invention relates to support devices, and more particularly to adjustable support devices such as jacks or jack stands.

Jack stands are known in the art. See for example U.S. Pat. No. 4,556,163. Scissor jacks are also known in the art. A typical scissor jack includes a scissor mechanism which is extended and contracted by a screw arrangement.

SUMMARY OF THE INVENTION

The invention provides an improved adjustable support device, preferably a jack stand, for supporting a vehicle above the ground.

The jack stand comprises a base, and an extensible and contractible scissor mechanism mounted on the base. The scissor mechanism includes a plurality of elongated members pivotally connected in scissor-like fashion by a plurality of horizontally extending pins. The jack stand also includes ratch means for securing the scissor mechanism in a fixed position. Preferably, the ratch means includes a ratch pivotally connected to one of the pins, and the ratch includes a plurality of spaced recesses for removably housing another of the pins. The distance between the pins and thus the amount of extension of the scissor mechanism can be selectively varied by changing the recess in which the pin is housed.

The invention also provides a clamping mechanism adapted to be used on the jack stand or on a similar device. Preferably, the clamping mechanism is mounted on the upper end of the scissor mechanism for releasably clamping the pinch weld of a vehicle supported by the jack stand. In the preferred embodiment, the clamping mechanism translates the weight of the vehicle into a clamping force exerted by the clamping mechanism on the pinch weld. Thus, the heavier the vehicle, the greater the clamping force. The clamping mechanism substantially prevents slippage between the vehicle and the jack stand.

The invention also provides a scissor jack comprising the above-discussed base and clamping mechanism.

Other features and advantages of the invention will become apparent to those skilled in the art upon review of the following detailed description, claims and drawings.

Figure 1:
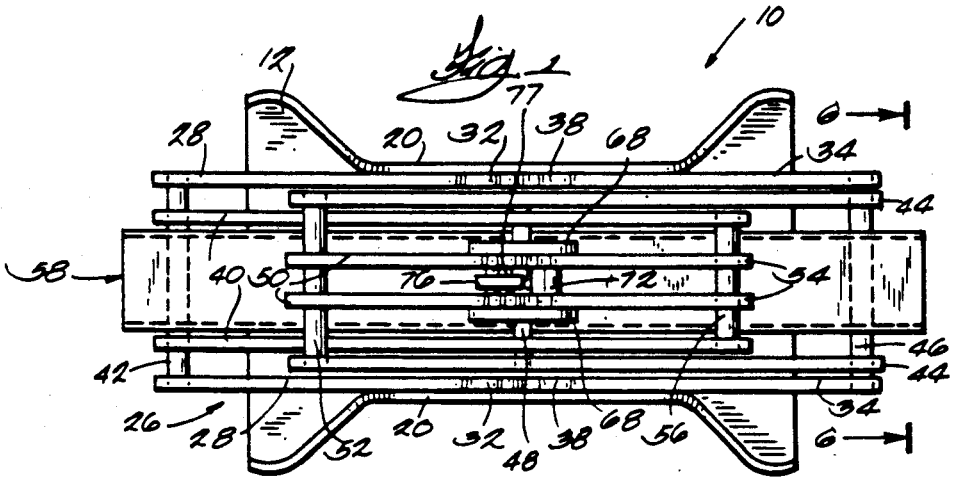
FIG. 1 is a top view of a collapsed jack stand embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A jack stand 10 which embodies the invention is illustrated in FIGS. 1 through 5.

The jack stand 10 comprises a conventional base 12 adapted to be supported by the ground. The base 12 includes a pair of spaced apart, vertically extending flanges 20. The jack stand 10 also comprises a vertically extensible and contractible mechanism mounted on the base. While various suitable mechanisms can be employed, in the preferred embodiment, the mechanism includes scissor means 26.

Figure 2:
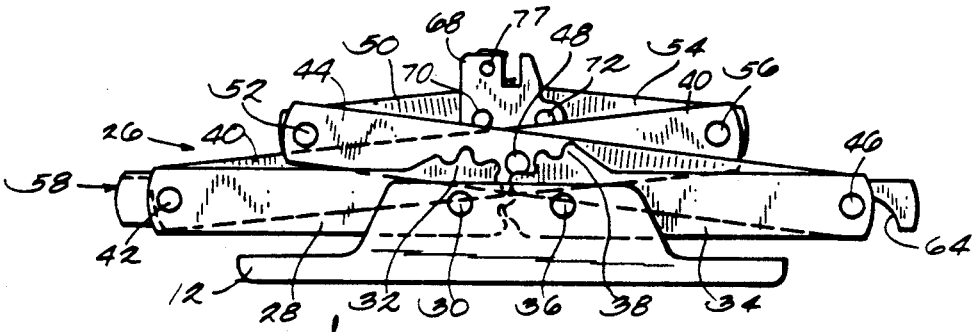
FIG. 2 is a side view of the collapsed jack stand.
Figures 3, 7, 8:
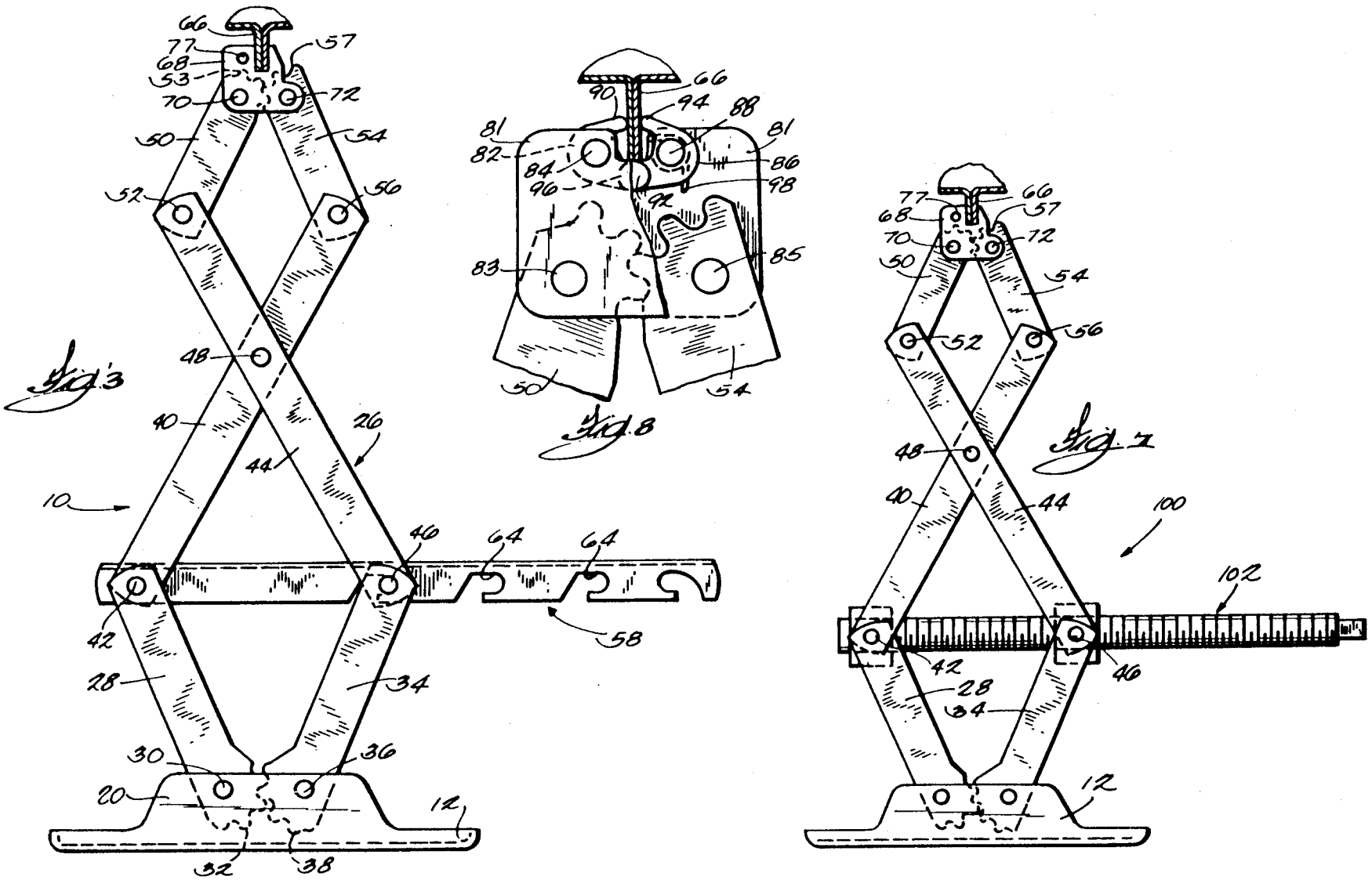
FIG. 3 is a side view of the jack stand extended.
FIG. 7 is a side view of a scissor jack which is an alternative embodiment of the invention.
FIG. 8 is an enlarged, partial, side view of the upper end of a jack stand which is an alternative embodiment of the invention.

In the illustrated construction, the scissor means 26 includes a pair of lower left elongated members 28 having upper and lower ends. The lower ends of the elongated members 28 are pivotally mounted on a pin 30 extending between the flanges 20 of the base 12. As shown in FIGS. 2 and 3, the lower ends of the members 28 have thereon a plurality of spaced teeth 32. The scissor means 26 also includes a pair of lower right elongated members 34 having upper and lower ends. The lower ends of the elongated members 34 are pivotally mounted on a pin 36 which extends between the flanges 20 of the base and which is spaced from the pin 30. Each of the members 34 has thereon a plurality of spaced teeth 38 which mesh with the teeth 32 on the lower end of an associated one of the members 28. The meshed teeth maintain a relationship between the lower members 28 and 34 such that the left and right lower members are always bisected by a vertical plane.

Thus, the lower members 28 and 34 are connected together for pivotal movement about a generally horizontal axis and so that the upper ends of the lower members 28 and 34 are vertically, adjustably moveable.

The scissor means 26 also includes a pair of middle left elongated members 40 having upper and lower ends. The lower ends of the middle left members 40 are pivotally connected to the upper ends of the lower left members 28 by a pin 42. The scissor means 26 also includes a pair of middle right elongated members 44 having upper and lower ends. The lower ends of the middle right members 44 are pivotally connected to the upper ends of the lower right members 34 by a pin 46. Also, the middle right members 44 are pivotally connected to the middle left members 40 by a pin 48 located at a point intermediate the ends of each of the members 40 and 44.

Thus, the middle members 40 and 44 are connected together for pivotal movement about a generally horizontal axis and so that the upper ends of the middle members are vertically, adjustably moveable.

The scissor means 26 also includes a pair of upper left elongated members 50 having upper and lower ends. The lower ends of the upper left members 50 are pivotally connected to the upper ends of the middle right members 44 by a pin 52. The upper ends of the upper left members 50 have thereon a plurality of spaced teeth 53. The scissor means 26 also includes a pair of upper right elongated members 54 having upper and lower ends. The lower ends of the upper right members 54 are pivotally connected to the upper ends of the middle left members 40 by a pin 56. The upper ends of the upper right members 54 have thereon a plurality of spaced teeth 57 which mesh with the teeth 53 on the upper end of an associated one of the upper left members 50. The meshed teeth maintain a relationship between the members 50 and 54 such that they are always bisected by a vertical plane.

The jack stand 10 also comprises means for securing the extensible and contractible mechanism, i.e., the scissor means, in a fixed position. While various suitable securing means can be employed, in the preferred embodiment, the securing means includes means connected between the pin 42 and the pin 46 for releasably securing the pins 42 and 46 in spaced relationship and for selectively varying the spacing between the pins. Alternatively stated, because the pin 42 is connected to the lower left member 28 and the pin 46 is connected to the lower right member 34, the securing means includes means connected between a first point located on the lower left member 28 and a second point located on the lower right member 34 for releasably securing the first and second points in spaced relationship and for selectively varying the spacing between the first and second points. Further alternatively stated, because the pin 42 is connected to the middle left member 40 and the pin 46 is connected to the middle right member 44, the securing means includes means connected between a first point located on the middle left member 40 and an second point located on the middle right member 44 for releasably securing the first and second points in spaced relationship and for selectively varying the spacing between the first and second points.

Figure 6:
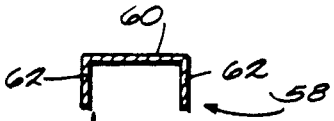
FIG. 6 is a view taken along line 6—6 in FIG. 1.

While various suitable connecting means can be used, in the illustrated construction, the connecting means includes ratch means. The ratch means includes the pin 46, and a ratch 58 having a longitudinal axis and an end pivotally supported by the pin 42. As shown in FIG. 6, the ratch 58 is preferably channel-shaped and includes a generally horizontal portion 60 and a pair of spaced apart vertical side portions 62. The side portions 62 include a plurality of aligned recesses 64 which are formed in the lower edges of the side portions 62 and which are adapted to removably house the pin 46. The recesses 64 are spaced from the pin 42 and are spaced along the lower edges of the side portions 62 in the direction of the longitudinal axis of the ratch 58.

Alternatively stated, because the pin 42 is connected to the lower left members 28 and to the middle left members 40, and because the pin 46 is connected to the lower right members 34 and to the middle right members 44, the ratch means includes projection means (the pin 46) located on the members 34 and on the members 44, and a ratch 58 connected to the members 28 and to the members 40.

As is apparent from viewing FIG. 3, location of the pin 46 in an aligned pair of the recesses 64 secures the pins 42 and 46 in spaced relationship and thereby secures the scissor means 26 in a fixed position. The spacing between the pins 42 and 46 and thus the amount of extension of the scissor means 26 can be selectively varied by changing the recesses 64 in which the pin 46 is housed.

The jack stand 10 further comprises means mounted on the extensible mechanism, i.e., on the scissor means 26, for supporting the load above the ground. While various suitable supporting means can be used, in the preferred embodiment, the supporting means includes means connected to the upper ends of the upper members 50 and 54 for supporting the load above the ground.

In order to prevent slippage between the supporting means and the load, the supporting means preferably includes means for releasably clamping the load. In the preferred embodiment, the jack stand 10 is adapted to support a vehicle, and the clamping means releasably clamps the pinch weld 66 of the vehicle.

Figure 4:
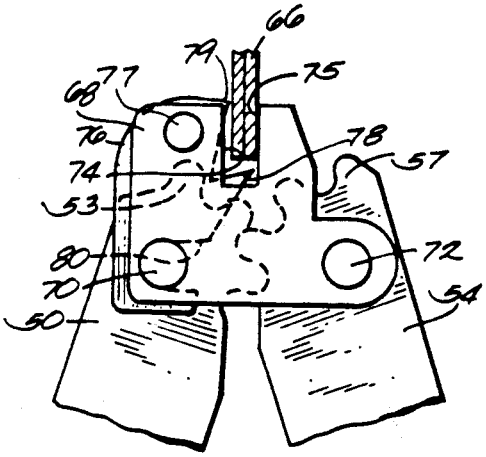
FIG. 4 is an enlarged, partial, side view of the upper end of the jack stand.
Figure 5:
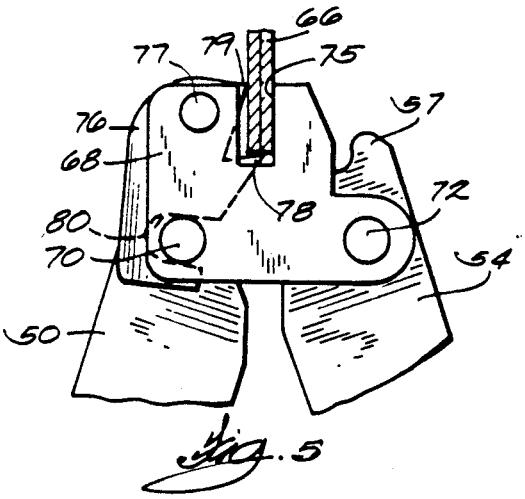
FIG. 5 is a view similar to FIG. 4.

The clamping means includes means for translating the weight of the load or of the vehicle into a clamping force exerted by the clamping means on the load or on the pinch weld 66 of the vehicle. Preferably, the clamping means includes (see FIGS. 4 and 5) a pair of vertically oriented plates 68 which are pivotally connected to the upper ends of the upper left members 50 by a pin 70, and which are pivotally connected to the upper ends of the upper right members 54 by a pin 72. As shown in FIG. 4, each plate 68 has in its upper edge a downwardly extending slot 74 which is partially defined by a wall 75. The clamping means also includes a clamping member 76 which is pivotally mounted on the plates 68 by a pin 77 and which is pivotally movable between an open position (FIG. 4) and a closed position (FIG. 5). The clamping member 76 includes a load supporting portion 78 extending across the slots 74, a load clamping portion 79, and a slot 80 which normally engages the pin 70 and prevents counter-clockwise (as shown in FIG. 4) rotation of the clamping member 76 beyond the open position. The clamping member 76 is weighted so as to be biased to the open position by the force of gravity.

When the jack stand 10 is extended, the pinch weld 66 is received in the slot 74, and the load supporting portion 78 engages the bottom of the pinch weld 66 so that the clamping member 76 pivots clockwise and the clamping portion 79 clampingly engages the pinch weld 66 between the clamping portion 79 and the wall 75 of the slot 74.

When the jack stand 10 supports the vehicle, the clamping member 76, and more particularly the load supporting portion 78 of the clamping member 76, supports at least a portion of the weight of the vehicle. Thus, the vehicle exerts a force on the load supporting portion 78 of the clamping member 76. This force causes pivotal movement of the clamping member 76 so that the clamping portion 79 exerts a clamping force on the pinch weld 66. Therefore, the clamping force is proportional to the force exerted by the vehicle on the load supporting portion 78. In other words, the clamping member 76 translates the weight of the vehicle into a clamping force exerted by the clamping member 76 on the pinch weld 66 of the vehicle. The advantage of this arrangement is that a heavier vehicle results in a greater clamping force.

An alternative construction of the clamping means is shown in FIG. 8. In the alternative construction, the clamping means includes a pair of vertically oriented plates 81 mounted on the upper ends of the members 50 and 54 by respective pins 83 and 85. The clamping means also includes a first clamping member or bellcrank 82 pivotally mounted on the plates 81 by a pin 84, and a second clamping member or bellcrank 86 pivotally mounted on the plates 81 by a pin 88. Thus, the first clamping member 82 is mounted for pivotal movement about a first axis, and the second clamping member 86 is mounted for pivotal movement about a second axis spaced from the first axis.

The first clamping member 82 includes (see FIG. 8) a middle portion supported by the pin 84, a first lever arm or projection terminating in a first clamping portion 90, and a second lever arm or projection which terminates in a first load supporting portion 92 and which extends toward the second clamping member 86. The second clamping member 86 includes a middle portion supported by the pin 88, a first lever arm or projection terminating in a second clamping portion 94 spaced from the first clamping portion 90, and a second lever arm or projection which terminates in a second load supporting portion 96 and which extends toward and side-by-side with the first load supporting portion 92.

In the alternative construction, the clamping means is biased open. More particularly, the load clamping portions 90 and 94 are biased apart. While various suitable biasing means can be used, in the illustrated construction, the biasing means includes (see FIG. 8) torsion springs 98.

As shown in FIG. 8, when the jack stand 10 is extended, the load supporting portions 92 and 96 engage the load or the bottom of the pinch weld 66 so that the clamping member 86 pivots clockwise and the clamping member 82 pivots counterclockwise. As a result, the clamping portions 90 and 94 move together and clampingly engage the pinch weld 80.

Like the clamping means of the preferred embodiment, the clamping members translate the weight of the vehicle into a clamping force exerted by the clamping members on the pinch weld of the vehicle.

A scissor jack 100 which is an alternative embodiment of the invention is illustrated in FIG. 7. The scissor jack 100 has many elements in common with the jack stand 10, and common elements have been given the same reference numerals.

Specifically, the scissor jack 100 is substantially identical to the jack stand 10 except that, instead of ratch means, the scissor jack includes a conventional screw arrangement 102 for releasably securing the pins 42 and 46 in spaced relationship and for selectively varying the spacing between the pins 42 and 46. This arrangement is known in the art and will not be described in greater detail.

Various features and advantages of the invention are set forth in the following claims.

We claim:

1. A jack stand comprising a first elongated member having an upper end, a second elongated member having an upper end, means connected to said upper ends of said first and second members for supporting a load, means for connecting said first member to said second member such that said upper ends of said first and second members are vertically, adjustably movable in response to movement of said first elongated member with respect to said second elongated member, and ratch means connected between a first point located on said first member and a second point located on said second member for releasably securing said first and second points in spaced relationship and for selectively varying the spacing between said first and second points.

2. A jack stand as set forth in claim 1 wherein said ratch means includes projection means located on said first member at said first point, and a ratch connected to said second member at said second point, said ratch including a plurality of recesses spaced from said second point for removably housing said projection means.

3. A jack stand as set forth in claim 2 wherein said ratch has a longitudinal axis, and wherein said recesses are spaced in the direction of said longitudinal axis.

4. An adjustable scissor device for supporting a load above the ground, said device comprising a base adapted to be supported by the ground, a first elongated member having a first end supported by said base and an opposite second end, a second elongated member having a first end supported by said base and an opposite second end, means for connecting said first and second members together for pivotal movement about an axis, ratch means connected between a first point located on said first member and spaced from said axis and a second point located on said second member and spaced from said axis for releasably securing said first and second points in spaced relationship and for selectively varying the spacing between said first and second points, and means connected to said second end of said first member and to said second end of said second member for supporting the load above the ground and for releasably clamping the load.

5. A device as set forth in claim 4 wherein said ratch means includes projection means located on said first member at said first point, and a ratch connected to said second member at said second point, said ratch including a plurality of recesses spaced from said second point for removably housing said projection means.

6. A device as set forth in claim 5 wherein said ratch has a longitudinal axis, and wherein said recesses are spaced in the direction of said longitudinal axis.

7. A device as set forth in claim 4 wherein said clamping means includes means for translating the weight of the load into a clamping force exerted by said clamping means on the load.

8. A device as set forth in claim 7 wherein said translating means includes a clamping member having a portion which supports a part of the load and on which the load exerts a force, and a portion which clampingly engages another part of the load and which exerts a clamping force on the load, said clamping force being proportional to said force exerted by the load.

9. A device as set forth in claim 4 wherein said clamping means includes a first clamping member mounted for pivotal movement about a second axis, and a second clamping member mounted for pivotal movement about a third axis spaced from said second axis, said first clamping member including a first load clamping portion, and a first load supporting portion extending toward said second clamping member, and said second clamping member including a second load clamping portion spaced from said first load clamping portion, and a second load supporting portion extending toward and side-by-side with said first load supporting portion, said load supporting portions being engageable by the load so that said clamping members move pivotally and said load clamping portions move together and clampingly engage the load.

10. A device as set forth in claim 9 wherein said first clamping member includes a first bellcrank having a middle portion mounted for pivotal movement about said second axis, a first lever arm terminating in said first clamping portion, and a second lever arm which terminates in said first load supporting portion and which extends toward said second clamping member, and wherein said second clamping member includes a second bellcrank having a middle portion mounted for pivotal movement about said third axis, a first lever arm terminating in said second clamping portion, and a second lever arm which terminates in said second load supporting portion and which extends toward said second lever arm of said first bellcrank.

11. A device as set forth in claim 9 wherein said load clamping portions are biased apart.

12. A device as set forth in claim 4 wherein said clamping means is biased open and closes when clamping the load.

13. An adjustable jack stand for supporting a vehicle above the ground, said jack stand comprising a base adapted to be supported by the ground, scissor means mounted on said base, said scissor means including a first elongated member having a lower end supported by said base, and an upper end, a second elongated member having a lower end supported by said base, and an upper end, and means for connecting said first and second members together for pivotal movement about a generally horizontal axis, ratch means including a projection located on said first member at a first point spaced from said axis, and a ratch connected to said second member at a second point spaced from said axis, said ratch having a longitudinal axis and including a plurality of recesses for removably housing said projection, said recesses being spaced from said second point and spaced along said longitudinal axis, and means connected to said upper end of said first member and to said upper end of said second member for supporting the vehicle.

14. A device for supporting a load above the ground, said device comprising a base adapted to be supported by the ground, a vertically extensible and contractible mechanism mounted on said base, and means mounted on said mechanism for supporting the load, said means for supporting the load including means for releasably clamping the load, said clamping means including a first member mounted on said mechanism and having therein a downwardly extending slot, and a clamping member mounted on said first member for pivotal movement relative thereto about an axis, said clamping member including a load supporting portion extending across said slot, and a load clamping portion, said load supporting portion being engageable by the load when the load is inserted in said slot and being integrally connected to said load clamping portion for common pivotal movement with said load clamping portion about said axis so that said clamping member moves pivotally and said clamping portion clampingly engages the load when the load engages said load supporting portion in said slot.

15. A device as set forth in claim 14 wherein said clamping member is pivotally movable between an open position wherein said clamping portion permits insertion of the load into said slot, and a closed position wherein said clamping portion clampingly engages the load, and wherein said clamping member is biased toward said open position.

16. A device as set forth in claim 15 wherein said clamping member is weighted so as to be biased toward said open position by the force of gravity.

17. A device as set forth in claim 14 wherein said clamping means includes a first clamping member mounted for pivotal movement about a first axis, and a second clamping member mounted for pivotal movement about a second axis spaced from said first axis, said first clamping member including a first load clamping portion, and a first load supporting portion extending toward said second clamping member, and said second clamping member including a second load clamping portion spaced from said first load clamping portion, and a second load supporting portion extending toward and side-by-side with said first load supporting portion, said load supporting portions being engageable by the load so that said clamping members move pivotally and said load clamping portions move together and clampingly engage the load.

18. A device as set forth in claim 17 wherein said first clamping member includes a first bellcrank having a middle portion mounted for pivotal movement about said first axis, a first lever arm terminating in said first clamping portion, and a second lever arm which terminates in said first load supporting portion and which extends toward said second clamping member, and wherein said second clamping member includes a second bellcrank having a middle portion mounted for pivotal movement about said second axis, a first lever arm terminating in said second clamping portion, and a second lever arm which terminates in said second load supporting portion and which extends toward said second lever arm of said first bellcrank.

19. A device as set forth in claim 17 wherein said load clamping portions are biased apart.

20. A device as set forth in claim 14 wherein said clamping means is biased open and closes when clamping the load.

21. A device as set forth in claim 14 wherein said means for supporting the load also includes extensible and contractible scissor means mounted on said base, and screw means for securing said scissor means in a fixed position, and wherein said clamping means is mounted on said scissor means.

22. An apparatus for clamping the pinch weld of a vehicle, said apparatus being adapted to be mounted on a vehicle support device, and said apparatus comprising a first member mounted on the device and having therein a downwardly extending slot, and a clamping member mounted on said first member for pivotal movement relative thereto about an axis, said clamping member including a load supporting portion extending across said slot, and a load clamping portion, said load supporting portion being engageable by the pinch weld when the pinch weld is inserted in said slot and being integrally connected to said load clamping portion for common pivotal movement with said load clamping portion about said axis so that said clamping member moves pivotally and said clamping portion clampingly engages the pinch weld when the pinch weld engages said load supporting portion in said slot.

23. A device as set forth in claim 22 wherein said clamping member is pivotally movable between an open position wherein said clamping portion permits insertion of the load into said slot, and a closed position wherein said clamping portion clampingly engages the load, and wherein said clamping member is biased toward said open position.

24. A device as set forth in claim 23 wherein said clamping member is weighted so as to be biased toward said open position by the force of gravity.

25. An apparatus as set forth in claim 22 wherein said clamping means includes a first clamping member mounted for pivotal movement about a first axis, and a second clamping member mounted for pivotal movement about a second axis spaced from said second axis, said first clamping member including a first load clamping portion, and a first load supporting portion extending toward said second clamping member, and said second clamping member including a second load clamping portion spaced from said first load clamping portion, and a second load supporting portion extending toward and side-by-side with said first load supporting portion, said load supporting portions being engageable by the load so that said clamping members move pivotally and said load clamping portions move together and clampingly engage the load.

26. An apparatus as set forth in claim 25 wherein said first clamping member includes a first bellcrank having a middle portion mounted for pivotal movement about said first axis, a first lever arm terminating in said first clamping portion, and a second lever arm which terminates in said first load supporting portion and which extends toward said second clamping member, and wherein said second clamping member includes a second bellcrank having a middle portion mounted for pivotal movement about said second axis, a first lever arm terminating in said second clamping portion, and a second lever arm which terminates in said second load supporting portion and which extends toward said second lever arm of said first bellcrank.

27. An apparatus as set forth in claim 25 wherein said load clamping portions are biased apart.

28. An adjustable device for supporting a load above the ground, said device comprising a base adapted to be supported by the ground, a first elongated member having a first end supported by said base and an opposite second end, a second elongated member having a first end supported by said base and an opposite second end, means for connecting said first and second members together for pivotal movement about an axis, means connected between a first point located on said first member and spaced from said axis and a second point located on said second member and spaced from said axis for releasably securing said first and second points in spaced relationship and for selectively varying the spacing between said first and second points, and means connected to said second end of said first member and to said second end of said second member for supporting the load above the ground, said means for supporting the load including means for translating the weight of the load into a supporting force exerted by said clamping means on the load.

29. A device as set forth in claim 28 wherein said translating means includes a clamping member having a portion which supports a part of the load and on which the load exerts a force, and a portion which clampingly engages another part of the load and which exerts a clamping force on the load, said clamping force being proportional to said force exerted by the load.

30. A device as set forth in claim 29 wherein said translating means includes a first clamping member mounted for pivotal movement about a second axis, and a second clamping member mounted for pivotal movement about a third axis spaced from said second axis, said first clamping member including a first load clamping portion, and a first load supporting portion extending toward said second clamping member, and said second clamping member including a second load clamping portion spaced from said first load clamping portion, and a second load supporting portion extending toward and side-by-side with said first load supporting portion, said load supporting portions being engageable by the load so that said clamping members move pivotally and said load clamping portions move together and clampingly engage the load.

31. A device as set forth in claim 30 wherein said first clamping member includes a first bellcrank having a middle portion mounted for pivotal movement about said second axis, a first lever arm terminating i said first clamping portion, and a second lever arm which terminates in said first load supporting portion and which extends toward said second clamping member, and wherein said second clamping member includes a second bellcrank having a middle portion mounted for pivotal movement about said third axis, a first lever arm terminating in said second clamping portion, and a second lever arm which terminates in said second load supporting portion and which extends toward said second lever arm of said first bellcrank.

32. A device as set forth in claim 30 wherein said load clamping portions are biased apart.

33. A device as set forth in claim 28 wherein said means for releasably securing said first and second points includes screw means connected between said first and second points.

34. An adjustable scissor device for supporting a load above the ground, said device comprising a base adapted to be supported by the ground, a first elongated member having a first end supported by said base and an opposite second end, a second elongated member having a first end supported by said base and an opposite second end, means for connecting said first and second members together for pivotal movement about an axis, ratch means connected between a first point located on said first member and spaced from said axis and a second point located on said second member and spaced from said axis for releasably securing said first and second points in spaced relationship and for selectively varying the spacing between said first and second points, and means connected to said second end of said first member and to said second end of said second member for supporting the load above the ground and for releasably clamping the load, said clamping means including a first member having therein a downwardly extending slot, and a clamping member mounted on said first member for pivotal movement relative thereto about an axis, said clamping member including a load supporting portion extending across said slot, and a load clamping portion, said load supporting portion being engageable by the load when the load is inserted in said slot and being integrally connected to said load clamping portion for common pivotal movement with said load clamping portion about said axis so that said clamping member moves pivotally and said clamping portion clampingly engages the load when the load engages said load supporting portion in said slot.

35. A device as set forth in claim 34 wherein said clamping member is pivotally movable between an open position wherein said clamping portion permits insertion of the load into said slot, and a closed position wherein said clamping portion clampingly engages the load, and wherein said clamping member is biased toward said open position.

36. A device as set forth in claim 35 wherein said clamping member is weighted so as to be biased toward said open position by the force of gravity.

37. An adjustable device for supporting a load above the ground, said device comprising a base adapted to be supported by the ground, a first elongated member having a first end supported by said base and an opposite second end, a second elongated member having a first end supported by said base and an opposite second end, means for connecting said first and second members together for pivotal movement about an axis, means connected between a first point located on said first member and spaced from said axis and a second point located on said second member and spaced from said axis for releasably securing said first and second points in spaced relationship and for selectively varying the spacing between said first and second points, and means connected to said second end of said first member and to said second end of said second member for supporting the load above the ground, said means for supporting the load including means for translating the weight of the load into a clamping force exerted by said clamping means on the load, said translating means including a first member having therein a downwardly extending slot, and a clamping member mounted on said first member for pivotal movement relative thereto about an axis, said clamping member including a load supporting portion extending across said slot, and a load clamping portion, said load supporting portion being engageable by the load when the load is inserted in said slot and being integrally connected to said load clamping portion for common pivotal movement with said load clamping portion about said axis so that said clamping member moves pivotally and said clamping portion clampingly engages the load when the load engages said load supporting portion in said slot.

38. A device as set forth in claim 37 wherein said clamping member is pivotally movable between an open position wherein said clamping portion permits insertion of the load into said slot, and a closed position wherein said clamping portion clampingly engages the load, and wherein said clamping member is biased toward said open position.

39. A device as set forth in claim 31 wherein said clamping member is weighted so as to be biased toward said open position by the force of gravity.

* * * * *